US005587262A

United States Patent [19]

Pinkney et al.

[11] Patent Number: 5,587,262

[45] Date of Patent: Dec. 24, 1996

[54] PHOTOCONDUCTIVE IMAGING MEMBERS

[75] Inventors: Heidi Pinkney, Hamilton; Ah-Mee Hor; Zoran D. Popovic, both of Mississauga, all of Canada

[73] Assignee: Xerox Corporation, Stamford, Conn.

[21] Appl. No.: 537,015

[22] Filed: Oct. 2, 1995

[51] Int. Cl.[6] ..... G03G 5/047

[52] U.S. Cl. ..... 430/54; 430/59; 430/78

[58] Field of Search ..... 430/59, 58, 78, 430/73, 54

[56] References Cited

U.S. PATENT DOCUMENTS

| | | | |
|---|---|---|---|
| 4,587,189 | 5/1986 | Hor et al. | 430/59 |
| 5,166,339 | 11/1992 | Duff et al. | 540/141 |
| 5,189,155 | 2/1993 | Mayo et al. | 540/141 |
| 5,189,156 | 2/1993 | Mayo et al. | 540/141 |
| 5,407,766 | 4/1995 | Mayo et al. | 430/58 |
| 5,472,816 | 12/1995 | Nukada et al. | 430/78 |
| 5,492,785 | 2/1996 | Normandin et al. | 430/58 |

FOREIGN PATENT DOCUMENTS 221459 9/1989 Japan .

OTHER PUBLICATIONS

"No. 2–Study of Some Phthalocyanine Derivatives, Discussion on the Various Routes of Preparation", I–Phthalocyanines with Elements of Valence Greater Than Two, Mrs. Denise Colaitis, Bull. Soc. Chim. Fr., 23 (1962).

*Primary Examiner*—John Goodrow
*Attorney, Agent, or Firm*—E. O. Palazzo

[57] ABSTRACT

A photoconductive imaging member comprised of a supporting substrate, a hydroxygallium phthalocyanine photogenerator layer, a charge transport layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, and as a top layer a charge transport layer.

27 Claims, 1 Drawing Sheet

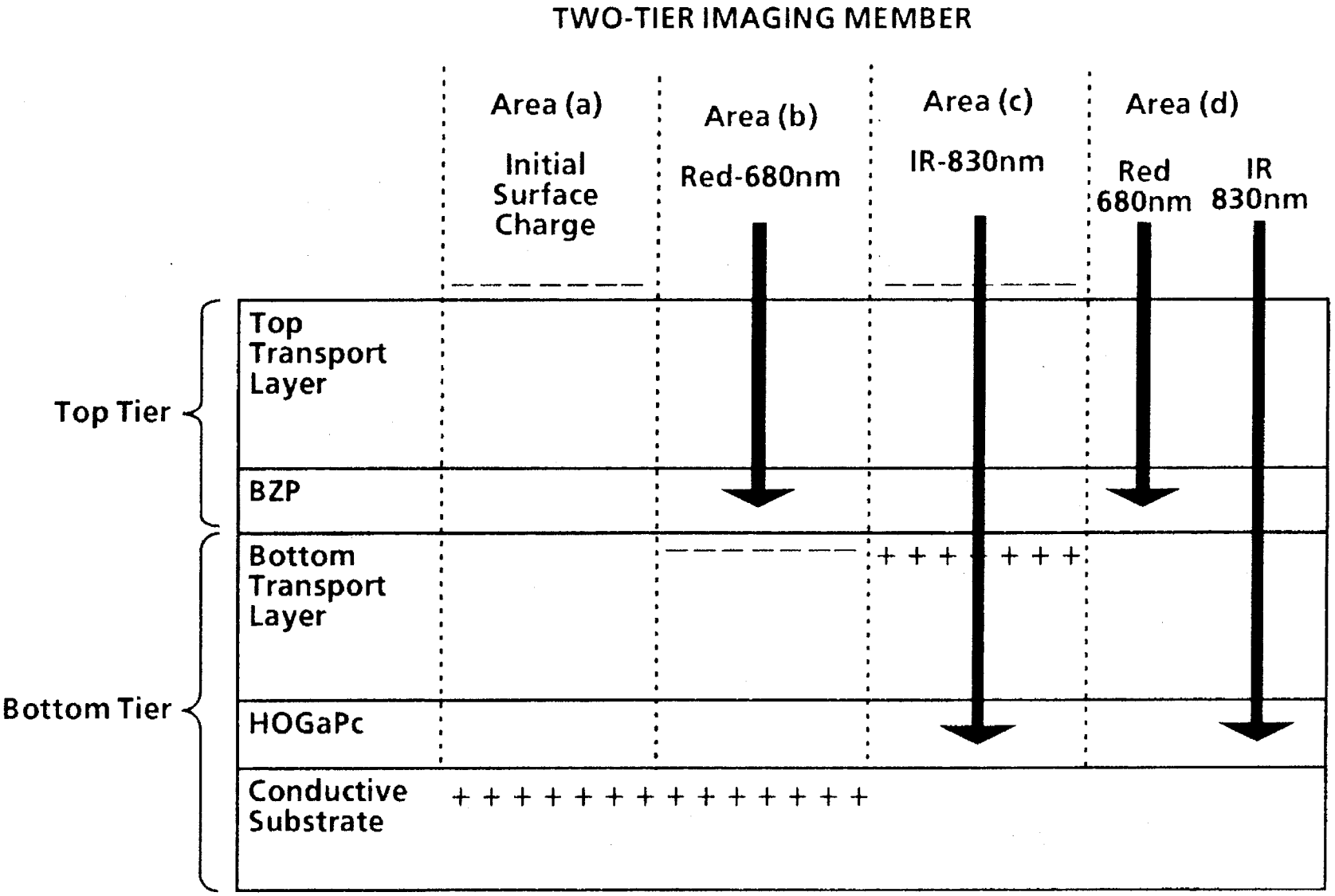
TWO-TIER IMAGING MEMBER
Area (a)
Initial Surface Charge
Area (b)
Red-680nm
Area (c)
IR-830nm
Area (d)
Red 680nm
IR 830nm
Top Transport Layer
BZP
Bottom Transport Layer
HOGaPc
Conductive Substrate
Top Tier
Bottom Tier

PHOTOCONDUCTIVE IMAGING MEMBERS

BACKGROUND OF THE INVENTION

This invention is generally directed to imaging members, and, more specifically, the present invention is directed to multilayered imaging members with two photogenerating layers, one of which is sensitive to a wavelength of from about 500 to about 800 nanometers, such as BZP, reference U.S. Pat. No. 4,587,189, the disclosure of which is totally incorporated herein by reference, and one of which is sensitive to a wavelength of from about 550 to about 950 nanometers, reference for example U.S. Ser. No. 332,304, the disclosure of which is totally incorporated herein by reference, especially Type V hydroxygallium phthalocyanine. The photogenerating layers can be exposed to light of the appropriate wavelengths simultaneously, sequentially, or alternatively only one of the photogenerating layers can be exposed. The imaging members of the present invention in embodiments exhibit excellent cyclic stability, independent layer discharge, and substantially no adverse changes in performance over extended time periods. Processes of imaging, especially xerographic imaging and printing, are also encompassed by the present invention. The aforementioned photoresponsive, or photoconductive imaging members can be negatively charged when the photogenerating layers are situated between the hole transport layers and the substrate, or positively charged when the hole transport layers are situated between the photogenerating layers and the supporting substrates. The layered photoconductive imaging members can be selected for a number of different known imaging and printing processes including, for example, electrophotographic imaging processes, especially xerographic imaging and printing processes wherein negatively charged or positively charged images are rendered visible using toner compositions of appropriate charge polarity. The imaging members as indicated herein are in embodiments sensitive in the wavelength region of from about 550 to about 900 nanometers, and in particular, from 700 to about 850 nanometers, thus diode lasers can be selected as the light source. Moreover, the imaging members of this invention are preferably useful in color xerographic applications where several color printings can be achieved in a single pass.

Photoresponsive imaging members with BZP alone, and hydroxygallium alone as a photogenerator pigment are known. These conventional photoresponsive imaging members are usually comprised of a single generator and a single transport layer, and they are used in xerographic printing processes to perform one pass/one color printing. Multiple color printing requires repeating the process several times depending on the number of colors selected. More recently, trilevel xerographic processes are known where two color printing can be achieved in a single pass. In the trilevel xerographic process, the conventional photoresponsive imaging members are used in one pass/two color printing processes. The imaging member is selectively discharged with a single laser source to create three potential levels and later toned to create two color printing.

Thus, there remains a need for improving the color printing capability of xerographic processes, and in particular, to print more colors with a minimum number of passes, and therefore, improve the productivity of the printing process. This can be achieved with the imaging members of the present invention wherein there are sequentially arranged four layers. These imaging members can be referred to as multilayered two-tier photoresponsive imaging member. The photodischarge behavior of two-tier imaging members is selectively controlled by the wavelengths of exposure light and hence the member can be fully discharged, partially discharged or zero discharged. There can be two possible partially discharged areas depending on the location of the photodischarge, top tier discharged or bottom tier discharge. The fully discharged and zero discharged areas can be developed with appropriate toners to provide two different colors. Also, a flood expose with a light effective on only the top tier can be employed to remove its partial charge to zero. The zero charge area can then be developed with another color toner. With two lasers of selected wavelengths, one effective on the top tier, the other on the bottom tier, and applying a further flood discharge on the top tier, three color printing in a single pass is achieved.

There is illustrated in JPLO 221459 a photoreceptor for use in electrophotography comprising a charge generation material and charge transport material on a conductive substrate, and wherein the charge generation material comprises phthalocyanine compounds which show the following intense diffraction peaks at Bragg angles (2 theta +/–0.2°) in the X-ray diffraction spectrum,

1—6.7, 15.2, 20.5, 27.0;

2—6.7, 13.7, 16.3, 20.9, 26.3; and

3—7.5, 9.5, 11.0, 13.5, 19.1,20.3, 21.8, 25.8, 27.1, 33.0.

In Konica Japanese 64-17066/89, there is disclosed, for example, the use of a new crystal modification of titanyl phthalocyanine (TiOPc) prepared from alpha-type TiOPc (Type II) by milling it in a sand mill with salt and polyethylene glycol. This publication also discloses that this new polymorph differs from alpha-type pigment in its light absorption and shows a maximum absorbance at 817 nanometers while the alpha-type exhibits a maximum at 830 nanometers. The Konica publication also discloses the use of this new form of TiOPc in a layered electrophotographic device having high photosensitivity at exposure radiation of 780 nanometers. Further, this new polymorph of TiOPc is also described in U.S. Pat. No. 4,898,799 and in a paper presented at the Annual Conference of Japan Hardcopy in July 1989. In this paper, this same new polymorph is referred to as Type Y, and reference is also made to Types I, II, and III as A, B, and C, respectively.

Layered photoresponsive imaging members have been described in a number of U.S. patents, such as U.S. Pat. No. 4,265,900, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of certain perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, Journal of Applied Photographic Engineering, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene, pigment photogenerating component. Both of the aforementioned patents disclose an aryl amine component as a hole transport layer.

Illustrated in U.S. Pat. No. 5,382,492 the disclosure of which is totally incorporated herein by reference, are processes for the preparation of Type II dihydroxygermanium phthalocyanine, which comprises the reaction of phthalonitrile or diiminoisoindolene with tetrahalogermanium or tetraalkoxygermanium in a suitable solvent, treatment of the resultant dihalogermanium phthalocyanine or dialkoxygermanium phthalocyanine intermediate with concentrated sulfuric acid, and then water, and filtering and washing of the dihydroxygermanium phthalocyanine precipitate with water using care that the filtrate of the washing does not exceed a pH of 1.0, removing the absorbed acid on the dihydroxygermanium phthalocyanine product with an organic base, such as amine, and optionally washing the pigment crystals with an aprotic organic solvent, such as an alkylene halide like methylene chloride, tetrahydrofuran, or dimethylformamide; and the preparation of Type II dihydroxygermanium phthalocyanine by polymorphic conversion from other polymorphs, such as Type I polymorph, by simply treating with concentrated sulfuric acid, followed by the same washing processes as described above. The different polymorphic forms of dihydroxygermanium phthalocyanine can be readily identified by various known analytical methods including solid state absorption spectra and X-ray powder diffraction analysis (XRPD).

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling said Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours such that there is obtained a hydroxygallium phthalocyanine Type V; ball milling contains very low levels of residual chlorine of from about 0.001 percent to about 0.1 percent; and in an embodiment about 0.03 percent of the weight of the Type V hydroxygallium pigment, as determined by elemental analysis.

The disclosures of all of the aforementioned publications, laid open applications, copending applications and patents are totally incorporated herein by reference.

BRIEF DESCRIPTION OF THE DRAWING

Illustrated in FIG. 1 is a graph illustrating a two-tier photoconductive imaging member of the present invention and imaging processes thereof.

SUMMARY OF THE INVENTION

It is an object of the present invention to provide imaging members thereof with many of the advantages illustrated herein.

Another object of the present invention relates to the provision of improved layered photoresponsive imaging members with photosensitivity to near infrared radiations.

It is yet another object of the present invention to provide improved layered photoresponsive imaging members with a sensitivity to visible light.

Moreover, another object of the present invention relates to the provision of improved layered photoresponsive imaging members with simultaneous photosensitivity to near infrared radiations, for example from about 550 to about 950 nanometers, and to light of a wavelength of from about 500 to about 800 nanometers.

It is yet another object of the present invention to provide photoconductive imaging members with two photogenerating layers, and two charge transport layers.

In a further object of the present invention there are provided imaging members containing as one of the photogenerating pigments Type V hydroxygallium phthalocyanine with XRPD peaks at Bragg angles of 7.4, 9.8, 12.4, 16.2, 17.6, 18.4, 21.9, 23.9, 25.0, 28.1, and the highest peak at 7.4 degrees 2Θ.

In still a further object of the present invention there are provided multilayered two-tier photoresponsive imaging members which can be selected for imaging processes including color xerography, such as three color printing by selectively discharging the two-tier imaging member wherein, for example, three different surface potentials can be obtained after exposure to light, that is for example zero voltage when both tiers are discharged; partial voltage when one tier is discharged; or full voltage when neither tier is discharged, reference for example FIG. 1.

These and other objects of the present invention can be accomplished in embodiments thereof by the provision of imaging members with, for example, a two-tier design. More specifically, the photoconductive imaging members of the present invention are comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, reference U.S. Pat. No. 4,587,189, the disclosure of which is totally incorporated herein by reference; and as a top layer a second charge transport layer. In embodiments, it is preferred that the BZP layer has an optical density of at least 2 to absorb about 99 percent or more of the 500 to 700 nanometers radiation so that the lower tier (HOGaPc generator and bottom transport layer) will not be discharged by such a radiation or any monochromatic light with wavelength within the range of 500 to 700 nanometers.

The two-tier imaging member is useful for performing in color xerographic printing processes. More specifically, when selectively imaged with two laser lights of different wavelengths, color xerographic printing enables printing of three colors in a single pass process. After being charged to about −1,200 volts, the imaging member is selectively discharged by exposure to a suitable type of light. The top tier comprising BZP and top transport layer is discharged by 680 nanometers of radiation. The bottom tier is discharged by 830 nanometers of radiation. Thus, four resultant areas on the imaging member are created after passing an imaging station; and (a) the unexposed area retains the original surface potential, i.e. −1,200 volts, (b) the area exposed with 680 nanometers, which is discharged to about one-half of the original surface voltage, i.e. −600 volts, (c) the area exposed with 830 nanometers, which is also discharged to about one-half of the original surface voltage, i.e. −600 volts; and (d) the area exposed with both 680 and 830 nanometers which is fully discharged, i.e. 0 volts. While only three potential levels are present on the imaging member at this stage immediately after exposure, there will be four distinctively different areas on the surface of the imaging after xerographic development as indicated herein. After toning the area (a) with charge area development (CAD), the surface potential of (a) is changed to −600 volts by a positively charged black toner. Then, applying discharge area development step (DAD) and toning area (b), the surface potential is changed to −600 volts by negatively charged toners. As a result, the four areas are at equal potential (−600 volts) at this stage. By exposing the imaging member with a broad band exposure 500 to 700 nanometers, only area (c) is further discharged to 0 volts as the BZP layer is photoactive in this wavelength range. Area (a) is not discharged as the toners on it block this radiation. Area (b) is not discharged because the top BZP generator layer completely absorbs the radiation. By applying a (DAD) step, area (c) is now toned with another color toner. Area (b) remains untoned. Therefore, three color toners can be deposited in a single pass.

Embodiments of the present invention include a method of imaging which comprises generating an electrostatic latent image on the imaging member comprised of a supporting substrate, a hydroxygallium phthalocyanine photogenerator layer, a charge transport layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2', 1'-a)anthra(2,1,9-def:6,5,10-d'e'f')diisoquinoline-10, 21-dione, and as a top layer a charge transport layer; developing the latent image; and transferring the developed electrostatic image to a suitable substrate; and wherein the imaging member is first exposed to light of a wavelength of from about 500 to about 800 nanometers, and then is exposed to light of a wavelength of from about 550 to about 950 nanometers; and a method of imaging which comprises generating an electrostatic latent image on an imaging member comprised of a supporting substrate, a hydroxygallium phthalocyanine photogenerator layer, a charge transport layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, and as a top layer a charge transport layer, developing the latent image; and transferring the developed electrostatic image to a suitable substrate; and wherein the imaging member is simultaneously exposed to light of a wavelength of from about 500 to about 800 nanometers; and a wavelength of from about 550 to about 950 nanometers.

The hydroxygallium photogenerating layer, which is preferably comprised of hydroxygallium phthalocyanine Type V, is in embodiments comprised of about 50 weight percent of the Type V and about 50 weight percent of a resin binder like polystyrene/polyvinylpyrridine; and the BZP layer is in embodiments comprised of 80 weight percent of BZP dispersed in a resin binder like polyvinylbutyral. The photoconductive imaging member with two photogenerating layers and two charge transport layers can be prepared by a number of methods, such as the coating of the layers, and more specifically as illustrated herein. Thus, the photoresponsive imaging members of the present invention can in embodiments be prepared by a number of known methods, the process parameters and the order of coating of the layers being dependent on the member desired. The photogenerating and charge transport layers of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from 40° to about 200° C. for from 10 minutes to several hours under stationary conditions or in an air flow. The coating is accomplished to provide a final coating thickness of from 0.01 to about 30 microns after it has dried. The fabrication conditions for a given layer can be tailored to achieve optimum performance and cost in the final members.

Imaging members of the present invention are useful in various electrostatographic imaging and printing systems, particularly those conventionally known as xerographic processes. Specifically, the imaging members of the present invention are useful in xerographic imaging processes wherein the Type V hydroxygallium phthalocyanine pigment absorbs light of a wavelength of from about 550 to about 950 nanometers, and preferably from about 700 to about 850 nanometers; and wherein the second BZP layer absorbs light of a wavelength of from about 500 to about 800 nanometers, and preferably from about 600 to about 750 nanometers. In these known processes, electrostatic latent images are initially formed on the imaging member followed by development, and thereafter, transferring the image to a suitable substrate. Moreover, the imaging members of the present invention can be selected for electronic printing processes with gallium arsenide diode lasers, light emitting diode (LED) arrays which typically function at wavelengths of from 660 to about 830 nanometers.

One negatively charged photoresponsive imaging member of the present invention is comprised, in the order indicated, of a supporting substrate, an adhesive layer comprised, for example, of a polyester 49,000 available from Goodyear Chemical, a photogenerator layer comprised of Type V hydroxygallium phthalocyanine, optionally dispersed in an inactive polymer binder, a hole transport layer thereover comprised of N,N'-diphenyl-N,N'-bis(3-methyl phenyl)-1,1'-biphenyl-4,4'-diamine dispersed in a polycarbonate binder, thereover a photogenerating layer of BZP, and a top layer of N,N'-diphenyl-N,N'-bis(3-methyl phenyl)-1,1'-biphenyl-4,4'-diamine dispersed in a polycarbonate binder.

Examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In one embodiment, the thickness of this layer is from about 75 microns to about 300 microns.

Generally, the thickness of each of the photogenerator layers depends on a number of factors, including the thicknesses of the other layers and the amount of photogenerator material contained in these layers. Accordingly, each layer can be of a thickness of from about 0.05 micron to about 10 microns, and more specifically, from about 0.25 micron to about 1 micron when each of the photogenerator composition is present in this layer in an amount of 30 to 75 percent by volume. The maximum thickness of the layers in an embodiment is dependent primarily upon factors, such as photosensitivity, electrical properties and mechanical considerations. The binder resin may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is from 0.01 to 30 microns and preferably from 0.1 to 15 microns after being dried at 40° C. to 150° C. for 5 to 90 minutes.

Illustrative examples of polymeric binder materials that can be selected for the photogenerator pigments include those polymers as disclosed in U.S. Pat. No. 3,121,006, the disclosure of which is totally incorporated herein by reference.

As adhesives usually in contact with the supporting substrate, there can be selected various known substances inclusive of polyesters, polyamides, poly(vinyl butyral), poly(vinyl alcohol), polyurethane and polyacrylonitrile. This layer is of a thickness of from about 0.001 micron to about 1 micron. Optionally, this layer may contain conductive and nonconductive particles, such as zinc oxide, titanium dioxide, silicon nitride, carbon black, and the like, to provide, for example, in embodiments of the present invention desirable electrical and optical properties.

Aryl amines selected for the hole transporting layers, which generally is of a thickness of from about 5 microns to about 75 microns, and preferably of a thickness of from about 10 microns to about 40 microns, include molecules of the following formula

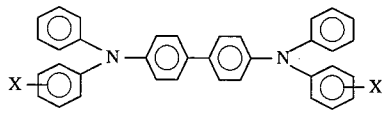

dispersed in a highly insulating and transparent polymer binder, wherein X is an alkyl group or a halogen, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder material for the transport layers include materials such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example of thermoplastic resin, pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. A comparative Example is also provided.

EXAMPLE I

Alkoxy-bridged Gallium Phthalocyanine Dimer Synthesis Using Gallium Methoxide Obtained From Gallium Chloride and Sodium Methoxide In Situ:

To a 1 liter round bottomed flask were added 25 grams of $GaCl^3$ and 300 milliliters of toluene, and the mixture was stirred for 10 minutes to form a solution. Then, 98 milliliters of a 25 weight percent sodium methoxide solution (in methanol) were added while cooling the flask with an ice bath to keep the contents below 40° C. Subsequently, 250 milliliters of ethylene glycol and 72.8 grams of o-phthalodinitrile were added. The methanol and toluene were quickly distilled off over 30 minutes while heating from 70° C. to 135° C., and then the phthalocyanine synthesis was performed by heating at 195° C. for 4.5 hours. The alkoxy-bridged gallium phthalocyanine dimer was isolated by filtration at 120° C. The product was then washed with 400 milliliters DMF at 100° C. for 1 hour and filtered. The product was then washed with 600 milliliters of deionized water at 60° C. for 1 hour and filtered. The product was then washed with 600 milliliters of methanol at 25° C. for 1 hour and filtered. The product was dried at 60° C. under vacuum for 18 hours. The alkoxy-bridged gallium phthalocyanine dimer, 1,2-di(oxogallium phthalocyaninyl) ethane, was isolated as a dark blue solid in 77 percent yield. The dimer product was characterized by elemental analysis, infrared spectroscopy, $^1H$ NMR spectroscopy and X-ray powder diffraction. Elemental analysis showed the presence of only 0.10 percent of chlorine. Infrared spectroscopy: major peaks at 573, 611, 636, 731, 756, 775, 874, 897, 962, 999, 1069, 1088, 1125, 1165, 1289, 1337, 1424, 1466, 1503, 1611, 2569, 2607, 2648, 2864, 2950, and 3045 $cm^{-1}$; $^1H$ NMR spectroscopy (TFA-d/$CDCl_3$ solution, 1:1 v/v, tetramethylsilane reference): peaks at (δ, ppm ±0.01 ppm) 4.00 (4H), 8.54 (16H), and 9.62 (16H); X-ray powder diffraction pattern: peaks at Bragg angles (2Θ±0.2°) of 6.7, 8.9, 12.8, 13.9, 15.7, 16.6, 21.2, 25.3, 25.9, and 28.3 with the highest peak at 6.7 degrees 2Θ.

EXAMPLE II

Hydrolysis of Alkoxy-bridged Gallium Phthalocyanine to Hydroxygallium Phthalocyanine (Type I):

The hydrolysis of alkoxy-bridged gallium phthalocyanine synthesized in Example I to hydroxygallium phthalocyanine was performed as follows. Sulfuric acid (94 to 96 percent, 125 grams) was heated to 40° C. in a 125 milliliter Edenmeyer flask, and then 5 grams of the chlorogallium phthalocyanine were added. Addition of the solid was completed in approximately 15 minutes, during which time the temperature of the solution increased to about 48° C. The acid solution was then stirred for 2 hours at 40° C., after which it was added in a dropwise fashion to a mixture comprised of concentrated (~30 percent) ammonium hydroxide (265 milliliters) and deionized water (435 milliliters), which had been cooled to a temperature below 5° C. The addition of the dissolved phthalocyanine was completed in approximately 30 minutes, during which time the temperature of the solution increased to about 40° C. The reprecipitated phthalocyanine was then removed from the cooling bath and allowed to stir at room temperature for 1 hour. The resulting phthalocyanine was then filtered through a porcelain funnel fitted with a Whatman 934-AH grade glass fiber filter. The resulting blue solid was redispersed in fresh deionized water by stirring at room temperature for 1 hour and filtered as before. This process was repeated at least three times until the conductivity of the flitrate was <20 μS. The filtercake was oven dried overnight at 50° C. to give 4.75 grams (95 percent) of Type I HOGaPc, identified by infrared spectroscopy and X-ray powder diffraction. Infrared spectroscopy: major peaks at 507, 573, 629, 729, 756, 772, 874, 898, 956, 984, 1092, 1121, 1165, 1188, 1290, 1339, 1424, 1468, 1503, 1588, 1611, 1757, 1835, 1951, 2099, 2207, 2280, 2384, 2425, 2570, 2608, 2652, 2780, 2819, 2853, 2907, 2951, 3049 and 3479 (broad) $cm^{-1}$; X-ray diffraction pattern: peaks at Bragg angles of 6.8, 13.0, 16.5, 21.0, 26.3 and 29.5 with the highest peak at 6.8 degrees 2Θ(2 theta +/−0.2°).

EXAMPLE III

Conversion of Type I Hydroxygallium Phthalocyanine to Type V:

The Type I hydroxygallium phthalocyanine pigment obtained in Example II was converted to Type V HOGaPc as follows. The Type I hydroxygallium phthalocyanine pigment (3.0 grams) was added to 25 milliliters of N,N-dimethylformamide in a 60 milliliter glass bottle containing 60 grams of glass beads (0.25 inch in diameter). The bottle was sealed and placed on a ball mill overnight (18 hours). The solid was isolated by filtration through a porcelain funnel fitted with a Whatman GF/F grade glass fiber filter, and washed in the filter using several 25 milliliter portions of acetone. The filtered wet cake was oven dried overnight at 50° C. to provide 2.8 grams of Type V HOGaPc which was identified by infrared spectroscopy and X-ray powder diffraction. Infrared spectroscopy: major peaksat 507, 571, 631, 733, 756, 773, 897, 965, 1067, 1084, 1121, 1146, 1165, 1291, 1337, 1425, 1468, 1503, 1588, 1609, 1757, 1848, 1925, 2099, 2205, 2276, 2384, 2425, 2572, 2613, 2653, 2780, 2861, 2909, 2956, 3057 and 3499 (broad) $cm^{-1}$; X-ray diffraction pattern: peaks at Bragg angles of 7.4, 9.8, 12.4, 12.9, 16.2, 18.4, 21.9, 23.9, 25.0 and 28.1 with the highest peak at 7.4 degrees 2Θ(2 theta +/−0.2°).

EXAMPLE IV

Fabrication and Testing of Two-Tier Imaging Member:

A two-tier imaging member was prepared by sequentially coating the four layers: 1) HOGAPC generator, 2) charge transport, 3) BZP generator, and 4) charge transport all contained on a supporting substrate of a titanized MYLAR®, which was precoated with a thin 0.025 micron silane blocking layer and a thin 0.1 micron polyester adhesive layer. The first photogenerating layer was hydroxygallium phthalocyanine as prepared above. The BZP for the second photogenerating layer was as illustrated in U.S. Pat. No. 4,587,189, and more specifically, was comprised of a mixture of about 50/50 weight percent of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione. The dispersion of Type V hydroxygallium phthalocyanine (HOGAPC) was prepared by milling 0.125 gram of the HOGAPC, prepared as described in Example III, from a precursor pigment, which was prepared as described in Example I, and 0.125 gram of polystyrene-b-polyvinylpyridine in 9.0 grams of chlorobenzene in a 30 milliliter glass bottle containing 70 grams of ⅛ inch stainless steel balls. The bottle was put on a norton roller mill running at 300 rpm for 20 hours. The dispersion was coated on the titanized MYLAR® substrate using 1 mil film applicator to form a photogenerator layer. The formed photogenerating layer HOGaPc was dried at 135° C. for 20 minutes to a final thickness of about 0.3 micron.

A hole transporting layer solution was prepared by dissolving 2.2 grams of N,N'-diphenyl-N,N-bis(3-methyl phenyl)-1,1'-biphenyl-4,4'-diamine, and 4.15 grams of polycarbonate in 43 grams of dichloromethane. The solution was coated onto the HOGaPc generator layer using a 7 mil film applicator. The charge transporting layer thus obtained was dried at 135° C. for 20 minutes to provide a final thickness of about 15 microns.

Thereafter, the BZP generator layer was coated thereover as illustrated above. The BZP dispersion was prepared by milling 0.20 gram of BZP pigment mixture, 0.05 gram of polyvinylbutyral, and 7.15 grams of butyl acetate in a 30 milliliter bottle containing 70 grams of ⅛ inch stainless steel balls. The milling lasted for 5 days. The BZP dispersion was coated with a 2 mil applicator and the coated device was dried at 135° C. for 20 minutes. The optical density of the BZP layer was greater than 2.5, and more specifically, about 2.7, as measured on a Shimadzu spectrophotometer. Finally, a transport layer, a second diamine hole identified above, was coated on top of the BZP layer and dried as illustrated before. The resulting device was comprised of four sequentially deposited layers, bottom HOGaPc generator layer/bottom charge transport layer/top BZP generator layer/top charge transport layer, and all contained on a titanized MYLAR® conductive substrate.

The xerographic electrical properties of the imaging member can be determined by known means, including as indicated herein electrostatically charging the surfaces thereof with a corona discharge source until the surface potentials, as measured by a capacitively coupled probe attached to an electrometer, attained an initial value $V_o$ of about −1200 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter.

When exposing the charged imaging member with the 680 nanometers of light at an intensity of 30 erg/cm$^2$, a photodischarge of 58 percent was obtained. Since the 680 nanometers of light was totally absorbed by the top BZP generator layer, only the upper tier of imaging member was discharged. When exposing the charged imaging member with the 830 nanometers of light at a intensity of 20 erg/cm$^2$, a photodischarged of 42 percent was observed. Since the BZP absorb a negligible amount of light at this wavelength, the photodischarge was activated by the bottom tier of imaging member which contained the HOGaPc generator layer. The imaging member was fully discharged when it was exposed to both 680 and 830 nanometers of light. These results clearly indicate that the photodischarge behavior of the two-tier imaging can be controlled by the type of monochromatic light used.

EXAMPLE V

Stability of Two-Tier Imaging Member:

The electrical stability of the two-tier imaging member of Example IV was monitored by repeating the charging and discharging steps 20,000 times. In the first cycle, the member was charged to $V_{ddp}$, about −1,200 volts, it was exposed to a broad band exposure 540 to 700 nanometers light to have the top tier partially discharged to V2 (about −750 volts) due to light absorption by BZP, and then further discharged by 800 to 850 nanometers of light (absorbed by HOGaPc in the bottom tier) to V3 (at about −70 volts). The variations in $V_{ddp}$, V2 and V3 provided an indication of the stability of the imaging member. In 20,000 cycles, the changes ΔVddp, V2, V3 were only 1, 34 and 51 volts indicating excellent electrical stability. The stability test was repeated again with charging, and discharging the bottom tier, and then the top tier using broad band lights of 850 to 1,000 nanometers, and 400 to 700 nanometers, respectively. The variations in Vddp, V2 and V3 were measured to be 2, 7 and 17 volts. Again, an excellent stability was observed. Whether the top or bottom tier of imaging member was the first to be discharged, the stability of the member was maintained.

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a hydroxygallium phthalocyanine photogenerator layer, a charge transport layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, and as a top layer a charge transport layer.

2. A photoconductive imaging member comprised of a supporting substrate, a first hydroxygallium phthalocyanine photogenerator layer which absorbs light of a wavelength of from about 550 to about 950 nanometers, a charge transport layer, a photogenerator layer comprised of a mixture of bisbenzimidazo(2,1-a-1',2'-b)anthra(2,1,9-def: 6,5,10-d'e'f')diisoquinoline-6,11-dione and bisbenzimidazo(2,1-a:2',1'-a)anthra(2,1,9-def:6,5,10-d'e'f')diisoquinoline-10, 21-dione which absorbs light of a wavelength of from about 500 to about 800 nanometers, and as a top layer a charge transport layer.

3. An imaging member in accordance with claim 1 wherein the first photogenerator layer is situated between the substrate and the charge transport layer, and the second photogenerator layer is situated between said first charge transport layer and a second top charge transport layer.

4. An imaging member in accordance with claim 1 wherein the supporting substrate is comprised of a conductive substrate comprised of a metal.

5. An imaging member in accordance with claim 4 wherein the conductive substrate is aluminum, aluminized MYLAR®, or titanized MYLAR®.

6. An imaging member in accordance with claim 1 wherein each photogenerator layer has a thickness of from about 0.05 to about 10 microns.

7. An imaging member in accordance with claim 1 wherein each transport layer has a thickness of from about 5 to about 30 microns.

8. An imaging member in accordance with claim 1 wherein the photogenerating layers are dispersed in a resinous binder in an amount of from about 5 percent by weight to about 95 percent by weight.

9. An imaging member in accordance with claim 8 wherein the resinous binder is selected from the group consisting of polyesters, polyvinyl butyrals, polycarbonates, polystyrene-b-polyvinyl pyrridine, and polyvinyl formals.

10. An imaging member in accordance with claim 1 wherein said charge transport layers comprise aryl amine molecules.

11. An imaging member in accordance with claim 10 wherein the aryl amines are of the formula

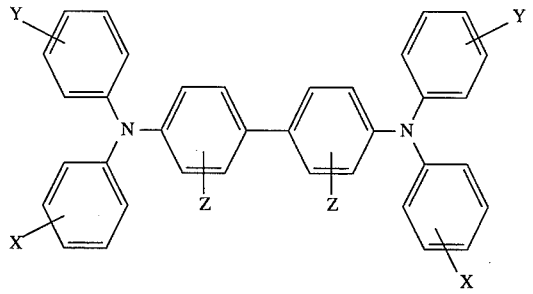

wherein X is selected from the group consisting of alkyl and halogen, and wherein the aryl amine is dispersed in a highly insulating and transparent resinous binder.

12. An imaging member in accordance with claim 11 wherein alkyl contains from about 1 to about 10 carbon atoms.

13. An imaging member in accordance with claim 11 wherein alkyl contains from 1 to about 5 carbon atoms.

14. An imaging member in accordance with claim 13 wherein alkyl is methyl.

15. An imaging member in accordance with claim 11 wherein halogen is chlorine.

16. An imaging member in accordance with claim 11 wherein the resinous binder is selected from the group consisting of polycarbonates and polystyrenes.

17. An imaging member in accordance with claim 11 wherein the aryl amines are molecules comprised of N,N'-diphenyl-N,N-bis(3-methyl phenyl)-1,1'-biphenyl-4,4'-diamine.

18. A method of imaging which comprises generating an electrostatic latent image on an imaging member comprised of a supporting substrate, a hydroxygallium phthalocyanine photofienerator layer, a charqe transport layer, a photogenerator layer comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,510-d'e'f')diisoquinoline-10, 21-dione, and as a top layer a charge transport layer, developing the latent image, and transferring the developed electrostatic image to a suitable substrate; and wherein the imaging member is first exposed to light of a wavelength of from about 500 to about 800 nanometers, and then is exposed to light of a wavelength of from about 550 to about 950 nanometers.

19. A method in accordance with claim 18 wherein said wavelengths are 680 and 830 nanometers, respectively.

20. A method of imaging which comprises generating an electrostatic latent image on an imaging member of claim 1, developing the latent image, and transferring the developed electrostatic image to a suitable substrate; and wherein the imaging member is simultaneously exposed to light of a wavelength of from about 500 to about 800 nanometers, and a wavelength of from about 550 to about 950 nanometers.

21. An imaging member in accordance with claim 1 wherein the hydroxygallium phthalocyanine is Type V hydroxygallium phthalocyanine.

22. An imaging member in accordance with claim 11 wherein the hydroxygallium phthalocyanine is Type V hydroxygallium phthalocyanine.

23. An imaging member in accordance with claim 22 wherein the Type V hydroxygallium phthalocyanine is prepared by hydrolyzing a gallium phthalocyanine precursor pigment by dissolving said hydroxygallium phthalocyanine in a strong acid and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said wet cake by drying in oven; and subjecting said resulting dry pigment to mixing with the addition of a second solvent to cause the formation of said hydroxygallium phthalocyanine.

24. An imaging member in accordance with claim 21 wherein the Type V hydroxygallium phthalocyanine has major peaks, as measured with an X-ray diffractometer, at 7.4, 9.8, 12.4, 16.2, 17.6, 18.4, 21.9, 23.9, 25.0, 28.1, and the highest peak at 7.4 degrees 2Θ.

25. A photoconductive imaging member consisting essentially of a supporting substrate, a first hydroxygallium phthalocyanine photogenerator layer which absorbs light of a wavelength of from about 550 to about 950 nanometers, a charge transport layer, a photogenerator layer consisting essentially of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione which absorbs light of a wavelength of from about 500 to about 800 nanometers, and as a top layer a charge transport layer.

26. An imaging member in accordance with claim 25 wherein the hydroxygallium phthalocyanine is situated on the supporting substrate, the charge transport layer is situated on said first hydroxygallium phthalocyanine photogenerator, and the photogenerator comprised of said mixture is situated on said charge transport layer.

27. An imaging member in accordance with claim 1 wherein said hydroxygallium photogenerator layer is comprised of about 50 weight percent of Type V hydroxygallium phthalocyanine and about 50 weight percent of the resin binder polystyrene/polyvinylpyrridine.

* * * * *